US005724910A

United States Patent [19]

Annesley et al.

[11] Patent Number: 5,724,910

[45] Date of Patent: Mar. 10, 1998

[54] SIGNALLING DEVICE

[76] Inventors: Robin John Annesley, 1166 Alder Avenue, Moose Jaw, Saskatchewan, Canada, S6H 0Y7; Dorothy Yakiwchuk, 1156 3rd Avenue N.W., Moose Jaw, Saskatchewan, Canada, S6H 3T8

[21] Appl. No.: 511,379

[22] Filed: Aug. 4, 1995

[51] Int. Cl.[6] ..... G08B 5/00

[52] U.S. Cl. ..... 116/209; 40/331; 116/201; 116/202

[58] Field of Search ..... 40/299, 331, 542, 40/586, 599, 658, 907; 116/200, 201, 202, 205, 209, 215, 306, 325

[56] References Cited

U.S. PATENT DOCUMENTS

| | | | |
|---|---|---|---|
| 823,782 | 6/1906 | Holden | 40/907 X |
| 1,409,595 | 3/1922 | Sheridan | 40/542 |
| 2,965,978 | 12/1960 | Olson | 116/306 |
| 3,913,092 | 10/1975 | Klingenberg . | |
| 3,940,865 | 3/1976 | Mori | 40/542 |
| 4,216,598 | 8/1980 | Newbert | 40/331 |
| 4,236,479 | 12/1980 | Walker et al. | 116/28 R |
| 4,348,978 | 9/1982 | Brucato . | |
| 4,773,171 | 9/1988 | Babbitt | 40/299 |
| 4,801,928 | 1/1989 | Minter . | |
| 4,862,617 | 9/1989 | Cooke, Jr. et al. | 40/663 |
| 4,899,683 | 2/1990 | Cuffaro | 116/215 |
| 5,130,909 | 7/1992 | Gross . | |
| 5,177,461 | 1/1993 | Budzyna et al. . | |
| 5,270,698 | 12/1993 | Hoyle et al. . | |
| 5,325,279 | 6/1994 | Freelove et al. . | |
| 5,560,491 | 10/1996 | Romaniuk et al. | 206/573 |

FOREIGN PATENT DOCUMENTS

| | | | |
|---|---|---|---|
| 148232 | 9/1952 | Australia | 40/542 |
| 779255 | 4/1935 | France | 40/542 |

*Primary Examiner*—Thomas B. Will
*Assistant Examiner*—Willie Morris Worth
*Attorney, Agent, or Firm*—Fasth Law Firm

[57] ABSTRACT

An apparatus, system and method for emergency under-door signalling includes a paddle in the form of an elongate strip of stiff plastic material bearing on its surface a phosphorescent marker. The strip may be slid under the door of an apartment or other building unit in an emergency situation, for example a fire, to indicate to emergency response personnel that the unit is occupied. The system includes a strip storage mechanism, for example a hook that will mount the paddle on a wall and an indicator for attachment to the outside of the door to indicate any relevant handicap that the unit occupant may suffer.

17 Claims, 3 Drawing Sheets

SIGNALLING DEVICE

FIELD OF THE INVENTION

The present invention relates to emergency signalling, and more particularly to an apparatus, system and method for signalling the presence of a person on one side of a door to persons on the other side of the door, while the door remains closed.

BACKGROUND

The apparatus and system of the invention are intended primarily for use in multi-unit buildings, for example apartment buildings, where, in an emergency such as a fire, persons may need to remain in their particular units awaiting assistance. It would be useful for emergency response personnel to have some direct indication as to which units were occupied, so that immediate efforts could be concentrated on assisting persons in those units. The common practise is to conduct a comprehensive search of the building, room to room.

SUMMARY

According to one aspect of the present invention there is provided an emergency under-door signalling apparatus including a paddle comprising an elongate, thin strip of stiff material and a luminescent marker on at least one surface of the strip, adjacent at least one end.

The paddle may be slipped under an entrance door as a signalling device in the event of an emergency. The luminescent marker is preferably a high emission phosphor of long duration. A currently preferred marker is made with the material sold under the trademark "Neolite". It is preferably in the shape of an arrow.

According to another aspect of the present invention there is provided a system for signalling the presence of a person on one side of a door to persons on the other side of the door without opening the door, said system including a paddle comprising an elongate, thin strip of stiff material configured to slide under the door from said one side to said other side, and a luminescent marker on at least one surface of the strip, adjacent at least one end thereof.

The system may also include means for storing the paddle at a readily accessible position near the door. This may, for example, be an aperture in one end of the paddle and a wall mounted hook, Preferably, the aperture is at the end of the strip opposite the marker, so that the correct end for sliding under the door can be detected quickly.

For a unit with handicapped occupants, the system may include an additional luminescent indicator for permanent attachment to the outside of the door. This indicator may represent in some way the handicap suffered by the occupant. For example, a stylized ear may be used where the occupant is hearing impaired. This allows emergency personnel to be prepared for a lack of response or possible difficulties in removing the occupant from the unit.

According to a further aspect of The present invention there is provided a method of Signalling the presence of a person on one side of a door to persons on the other side of the door without opening the door, said method comprising providing a paddle comprising an elongate, thin strip of stiff material and a luminescent marker on at least one surface of the strip, adjacent at least one end thereof, and sliding said one end of the paddle under the door from said one side to said other side with the marker on the uppermost side of the paddle.

Benefits of the invention include improved safety and reduced anxiety and stress on the part of building occupants. For an emergency response department, the system provides an efficient primary search of the building and reduced time delays in locating trapped persons. Introduction of the system also provides those concerned with the opportunity to provide and receive education concerning fire prevention, fire safety and other emergency response measures.

BRIEF DESCRIPTION OF THE DRAWINGS

In the accompanying drawings, which illustrate an exemplary embodiment of the present invention.

DETAILED DESCRIPTION

Figure 1:
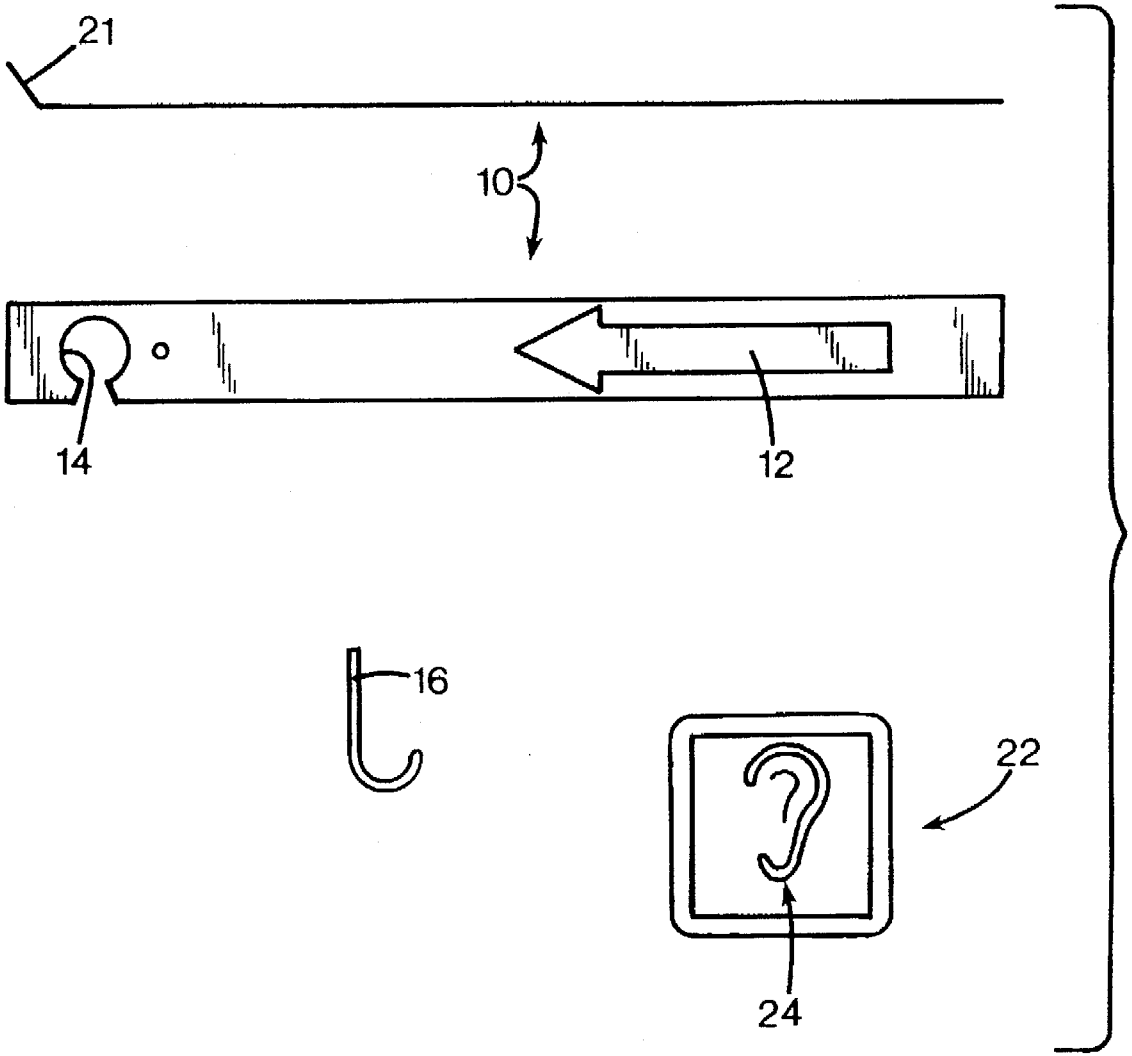
FIG. 1 illustrates the components of a system according to the present invention.
Figure 2:
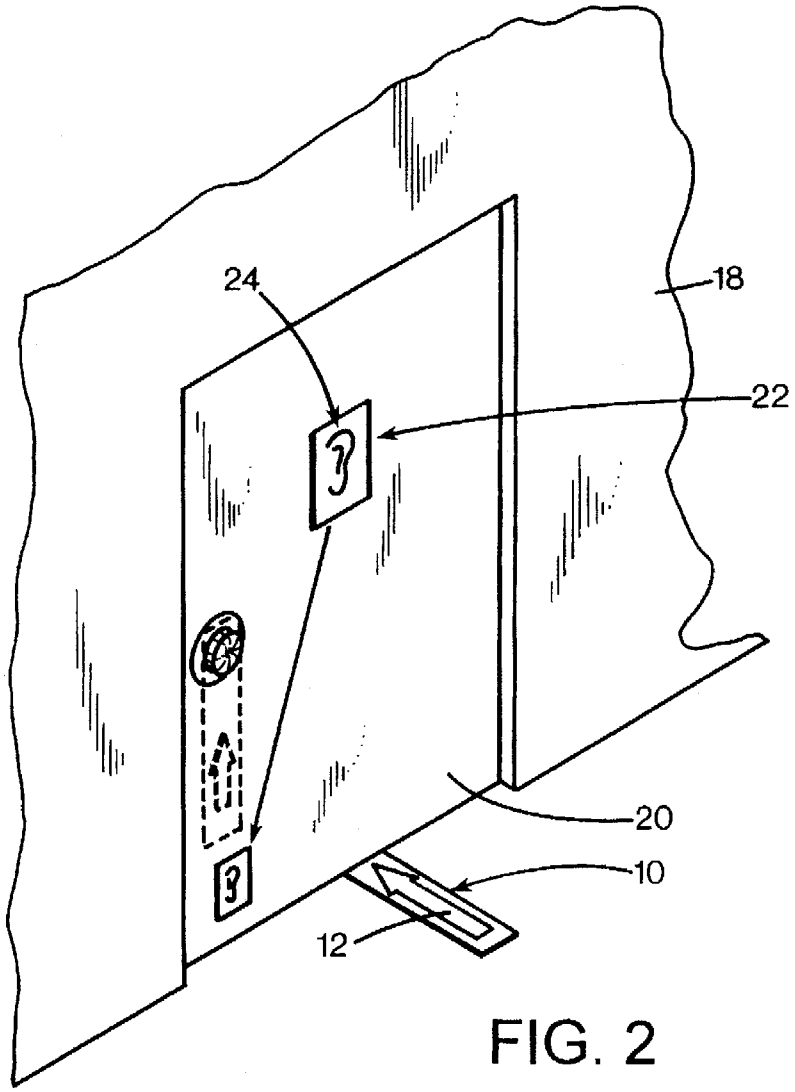
FIG. 2 is an isometric view showing the use of the system from outside of a unit door.
Figure 3:
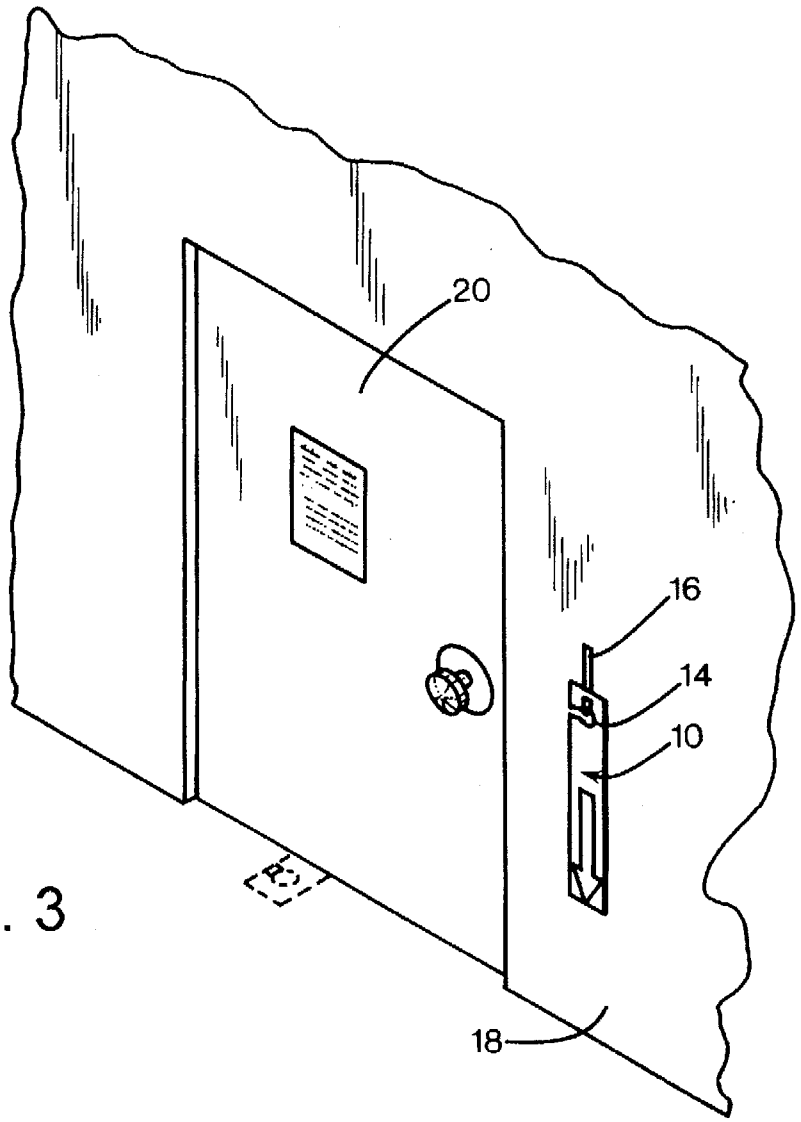
FIG. 3 is an isometric view showing the use of the system from the inside of the door.

Referring to the accompanying drawings, FIG. 1 illustrates a paddle 10 in the form of an elongate, rectangular strip of relatively stiff plastic material. The paddle has a phosphorescent marker 12 at one end in the form of a large arrow. This may be replicated on the opposite side of the paddle. The marker is made from the material sold under the trademark "Neolite". At the end of the paddle opposite the marker 12 is a large circular hole 14. This serves to suspend the paddle on a hook 16 mounted on a wall 18 adjacent an entrance door 20 as shown in solid line in FIG. 3, In an emergency, the paddle is removed from the hook and slid under the door as shown in broken line in FIG. 3 and in solid line in FIG. 2. The paddle includes an angular door stop 21 disposed at one end thereof. The door stop extends upwardly at an obtuse angle relative to the paddle 10.

The third part of the system is an indicator 22 which is, in the illustrated embodiment, a rectangular panel that remains attached to the outside of the door 20. This carries a phosphorescent marker 24 representing a handicap of a person habitually sited on the inside of the door 20. In the illustrated embodiment, the indicator represents an ear, indicating to emergency personnel that the person on the opposite side of the door is hearing impaired and can not be expected to respond to knocking on the door, a doorbell or the like.

While one embodiment of the present invention has been described in the foregoing, it is to be understood that other embodiments are possible within the scope of the invention and are intended to be included herein. The invention is to be considered limited solely by the scope of the appended claims.

We claim:

1. An emergency under-door signalling apparatus including a paddle comprising an elongate, thin strip of stiff material and a luminescent marker on at least one surface of the strip adjacent a first end, the strip having a second end opposite the first end, the second end having a door stop extending upwardly at an obtuse angle relative to the strip.

2. An apparatus according to claim 1 wherein the marker comprises a luminescent arrow.

3. An apparatus according to claim 1 including suspension means at one end of the strip.

4. An apparatus according to claim 3 wherein the suspension means comprise an aperture in the strip.

5. An apparatus according to claim 4 wherein the aperture is at an end of the strip opposite the marker.

6. An apparatus according to claim 1 wherein the luminescent marker comprises a phosphorescent marker.

7. A system for signalling the presence of a person on one side of a door to persons on the other side of the door without opening the door, said system including a paddle comprising an elongate, thin strip of stiff material configured to slide under the door from said one side to said other side, a luminescent marker on at least one surface of the strip, adjacent at least one end thereof and a door stop adjacent an end opposite the end that is adjacent the luminescent marker, the door stop extending upwardly at an obtuse angle relative to the strip.

8. A system according to claim 7 wherein the marker comprises a luminescent arrow.

9. A system according to claim 7 including suspension means at one end of the strip.

10. A system according to claim 9 wherein the suspension means comprise an aperture in the strip.

11. A system according to claim 10 wherein the aperture is at an end of the strip opposite the marker.

12. A system according to claim 9 wherein the suspension means further comprise a fixture mountable on a vertical surface adjacent the door and engageable with the paddle to support the paddle in a ready position adjacent the door.

13. A system according to claim 7 wherein the luminescent marker comprises a phosphorescent marker.

14. A system according to claim 13 further comprising a luminescent indicator means for mounting on said other side of said door, said indicator means being configured to represent a handicap suffered by a person habitually situated on said one side of said door.

15. A system according to claim 14 wherein the indicator means comprise a representation of an ear.

16. A system according to claim 14 wherein the luminescent indicator means is phosphorescent.

17. A method of signalling the presence of a person on one side of a door to persons on the other side of the door without opening the door, said method comprising providing a paddle comprising an elongate, thin strip of stiff material and a luminescent marker on at least one surface of the strip, adjacent at least one end thereof and an angular door stop disposed at an end of the paddle that is opposite the end of the luminescent marker, the door stop extending upwardly at an angle relative to the paddle, and sliding said one end of the paddle under the door from said one side to said other side with the marker on an uppermost side of the paddle until the angular door stop hits the door.

* * * * *